US006428465B1

(12) United States Patent
Belsinger, Jr.

(10) Patent No.: US 6,428,465 B1
(45) Date of Patent: Aug. 6, 2002

(54) INFANT CARE APPARATUS WITH UNIFORM FLOW PATTERN

(75) Inventor: Harry E. Belsinger, Jr., Catonsville, MD (US)

(73) Assignee: Datex - Ohmeda, Inc., Madison, WI (US)

( * ) Notice: Subject to any disclaimer, the term of this patent is extended or adjusted under 35 U.S.C. 154(b) by 0 days.

(21) Appl. No.: 09/503,073

(22) Filed: Feb. 12, 2000

Related U.S. Application Data

(60) Provisional application No. 60/170,266, filed on Dec. 11, 1999.

(51) Int. Cl.[7] ..... A61G 11/00
(52) U.S. Cl. ..... 600/22
(58) Field of Search ..... 600/21–22

(56) References Cited

U.S. PATENT DOCUMENTS 4,617,912 A 10/1986 Beer et al.
4,846,783 A 7/1989 Koch et al.
4,936,824 A 6/1990 Koch et al.
5,100,375 A 3/1992 Koch
5,707,337 A 1/1998 Franz
5,730,355 A 3/1998 Lessard et al.
5,944,651 A * 8/1999 Koch ..... 600/22

* cited by examiner

*Primary Examiner*—John P. Lacyk
(74) *Attorney, Agent, or Firm*—Roger M. Rathbun

(57) ABSTRACT

An incubator for use in caring for an infant having an infant platform underlying the infant and a plurality of sides extending upwardly from the infant platform and having a cover to form therein an infant compartment surrounding the infant in a controlled environment. A convective heating system is located in a heating and air moving compartment located beneath the infant and which serves to force heated air into the infant compartment to heat the infant and to withdraw return air from the infant compartment for re-circulation. The heated air is forced into the infant compartment through openings formed in the infant platform along both of the longitudinal sides of the generally rectangular infant compartment and then through double walls to emerge generally at the top of the infant compartment. The return air leaves the infant compartment through opening formed in the infant platform along both of the ends of the infant platform. Thus, the flow of air through the infant compartment is balanced and is uniformly distributed to enhance the creation of a uniform temperature profile within the infant compartment.

5 Claims, 4 Drawing Sheets

INFANT CARE APPARATUS WITH UNIFORM FLOW PATTERN

RELATED APPLICATIONS

This application is based upon Provisional Patent Application Serial No. 60/170,266 filed Dec. 11, 1999.

BACKGROUND

The present invention relates to an infant care apparatus and, more particularly, to an infant incubator having a uniform and symmetrical flow pattern to provide an even distribution of heat within the infant compartment.

There are, of course, many infant incubators available today for the caring of infants and to provide heat and, generally, humidity to that infant to aid in its wellbeing. In general, such incubators comprise an infant platform that is affixed to a base so as to locate the infant platform at a convenient height for the caregiver to view and attend to the infant. Within the infant platform, there is a flat, planar surface that underlies and supports the infant. A plurality of transparent sides generally extend upwardly from the infant platform to surround the infant and create the isolated infant compartment within which the infant is positioned. As indicated, the infant compartment allows the creation of a controlled environment and provides heat and humidity to the infant to aid in its growth and development.

In most incubators, the infant is heated by means of a heated flow of air that is introduced into the infant compartment to warm the infant and there is a recirculation of air from the infant compartment to be reintroduced to the heating system to be re-circulated back into the infant compartment. Thus, there is a heating and air moving compartment, normally positioned within the infant platform and located underneath the flat, planar surface on which the infant lies so as to be close to the infant compartment in order to conserve heat to the infant. That heating and air moving compartment contains the necessary components to heat and force the air into the infant compartment and conventionally comprise an electric heater and a motor powered fan to provide that heated air to the infant compartment.

The actual introduction of the heated air and the removal of air from the infant compartment also varies among incubators, however, it is preferable that the air flow within the infant compartment be uniform so as to create a uniform, even heat distribution within that compartment. As used hereinafter, since the base of the infant compartment is generally rectangular, there is a long dimension that will be referred to as the longitudinal side of the infant compartment or incubator and a shorter dimension that will be referred to as the end of the infant compartment or incubator. In use, the infant is normally placed parallel to the longitudinal sides of the infant compartment and there are access doors along those sides or side, so that access can be had to the infant by the caregiver.

In various incubators there are certainly differing systems to introduce the heated air into the infant compartment. For example, in U.S. Pat. No. 5,730,355 of Lessard et al, there is a flow pattern that introduces the heated air into an infant compartment through openings along the elongated sides of the infant compartment and to cause the air to exit from the infant compartment along only one of the ends of the infant compartment. Accordingly, the air flow is not uniform as all of the air introduced is removed along one of the ends and would tend to create a cooler area at the upper end of the infant compartment where there is no opening for the air to exit the infant compartment. The non-uniformity can also create a cooler area on the inside walls of the incubator.

Further, in Beer et al, U.S. Pat. No. 4,617,912, there is an air flow pattern wherein the heated air enters the infant compartment along both of the sides of the incubator and exits the infant compartment along the ends of the infant compartment. While more uniform, it is noted that the air directly enters the infant compartment at the bottom of the compartment and does not pass through a double walled door to enter the infant compartment at the top thereof. Thus, the inflow of warm air is subject to partial blockages or diversions that may be caused by a blanket or other material within the infant compartment that can upset the uniformity of the warm air flow at the sides of the incubator where such items may be present.

As an example of means to avoid partial blockages of side openings of the warm air into an infant compartment, double walls are used in some infant incubators, such as in Koch et al U.S. Pat. No. 4,936,824, where the inner walls of the infant compartment are actually heated by the flow of the heated air to raise the temperature of those walls in order to reduce the radiant energy loss of the infant to such walls. When such double walls are used, therefore, it is desirable that the wall temperature be fairly uniform across the inner surface of the walls. Again, therefore, a uniform, symmetrical flow pattern would be advantageous. As is noted in Koch et al, while blockage of the inlet flow paths are eliminated, there is a distribution pattern of the heated air that follows the inlet passage within the hood from front to back of the infant compartment where the air is substantially contained within the walls of the hood. Basically, in the Koch et al construction, there is an inlet along one longitudinal side and one outlet along the opposite longitudinal side with the heated air contained generally within a passageway formed between a double walled hood.

Accordingly, it would be desirable to provide a heating system that introduces the heated air into the infant compartment in a uniform pattern so that the areas within the infant compartment are generally at the same temperature and with the use of air passages through double walls of the infant compartment. As such, the areas of the double walls are at a more uniform temperature to lower the heat loss of the infant. In addition, it would be further advantageous to be able to provide a uniform flow pattern with a minimum of components in convective heating system by means of a heating and air moving compartment that is efficient and yet which provides the heating and air movement along the paths desired by utilizing large, molded components.

SUMMARY OF THE INVENTION

Accordingly, the present invention relates to an infant incubator that has a base and a frame extending upwardly from the base and which has an infant platform extending outwardly, preferably in cantilever manner, from the frame. The infant platform has a flat, planar, generally rectangular surface to provide a support for positioning the infant and has longitudinal sides and ends. An infant compartment is formed about the infant resting on the flat, planar surface by means of peripheral walls extending upwardly from said longitudinal sides and the ends and a cover that encloses and retains the infant within a controlled environment.

A convective heating system is used to force a flow of heated air into the infant compartment and to return air from that infant compartment. In the preferred embodiment, the components of the convective heating system are located in a heating and air moving compartment that is located within the infant platform just beneath the flat, planar surface on which the infant rests to minimize the loss of heat between the convective heating system and the infant compartment. Those components of the convective heating system include a fan, a motor to power the fan, a heater, and the various ducting and passageways to direct the air into and out of the infant compartment.

In that heating and air moving compartment, the convective heating system is readily constructed and assembled by a minimum, of large molded plastic components including a one-piece molded chassis and a molded upper pan that fits over the chassis and forms therebetween a lower chamber and an upper chamber.

In the preferred system, elongated inlets are formed along the opposite ends of the infant compartment and allow air to pass from the infant compartment through those elongated inlets and which then communicate with the lower chamber. In similar fashion, the upper chamber communicates with the infant compartment through elongated outlets that are formed along the longitudinal opposite sides of the infant compartment. A fan, powered by a motor, is located intermediate the upper and the lower chambers and serves to force the air from the lower chamber to the upper chamber and thus, to move the air from the infant compartment via the elongated inlets to return to the infant compartment t through the elongated outlets. In the preferred embodiment, a heater is located in the lower chamber to heat the air passing through that chamber.

In the system, therefore, the air thus moves from the infant compartment along the opposite ends and returns to the infant compartment along the opposite longitudinal sides of the infant compartment. Thus, with the use of only two molded plastic components, the system efficiently heats and delivers the air as desired with a minimum of components and thus is readily assembled.

By means of the present invention, the heated air from the convective heating system is introduced into the infant compartment along both of the longitudinal sides of the infant compartment and the return air leaves the infant compartment along both of the ends of the infant compartment via openings along those respective longitudinal sides and ends of the infant platform.

In the present invention, the side longitudinal walls of the infant incubator are double walls, that is, they comprise an inner and an outer wall spaced apart so as to form a passageway between the inner and outer walls to allow the heated air to pass through the longitudinal walls such that the heated air is introduced into the infant compartment at or near the upper regions of the infant compartment. In such manner, the side longitudinal walls are heated much in the same manner as in the Koch et al U.S. Pat. No. 4,936,824 to resist radiant losses from the infant through those walls.

According, the flow of heated and return air is basically symmetrical and uniform through the infant compartment. The heated air enters the infant compartment along both of the longitudinal sides of the flat, planar surface and leaves the infant compartment through both of the ends of the infant compartment and therefore the flow pattern, as well as the heat distribution throughout the infant compartment, is more uniform.

These and other features and advantages of the present invention will become more readily apparent during the following detailed description taken in conjunction with the drawings herein.

DETAILED DESCRIPTION OF THE INVENTION

Figure 1:
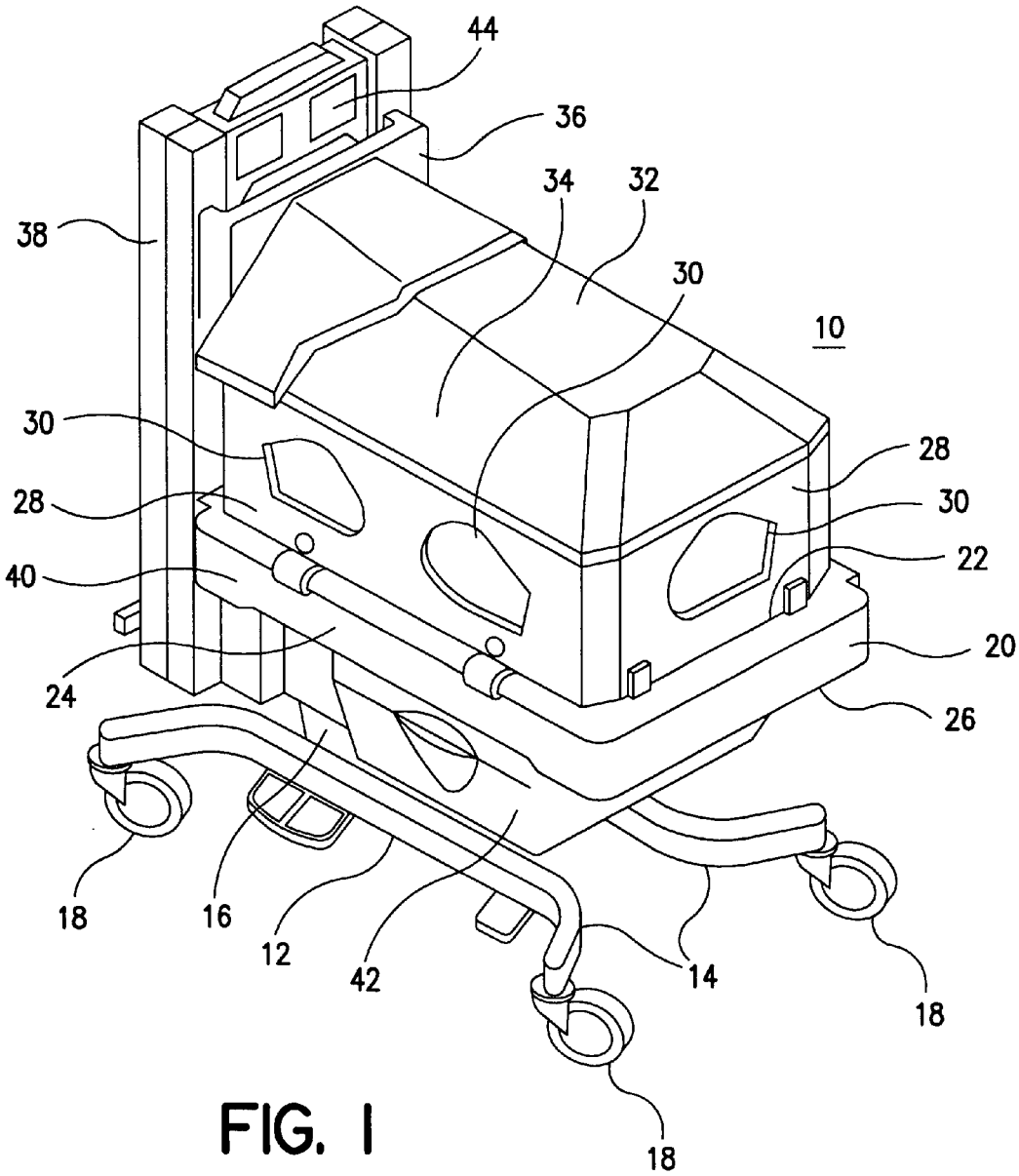
FIG. 1 is a perspective view of an incubator incorporating the present invention.

Referring now to FIG. 1, there is shown a perspective view of an incubator constructed so as to use the present invention. In the Figure, incubator 10 includes a base 12 comprising a pair of U-shaped members 14 that are joined together and which provide support for a base member 16. Wheels 18 may also be provide for ready movement of the infant care apparatus 10.

An infant platform 20 is provided and which supports an infant in the infant care apparatus 10 and the infant platform 20 may be mounted in cantilever manner to the base member 16. The infant platform 20 includes a flat, planar surface 22 that actually underlies the infant when positioned with the infant care apparatus 10.

As can be seen, the configuration of the incubator 10 is generally rectangular with its longer sides referred to as the longitudinal sides 24 and the shorter dimensioned sides being referred to as the ends 26. Extending upwardly around the periphery of the infant platform 20 and therefore from the longitudinal sides 24 and the ends 26 are a plurality of walls 28, normally of a transparent plastic material and which surround the flat planar surface 22 to enclose the infant on the surface 22. As can be seen, the walls 28 can have handholes 30 to enable the caregiver to reach the infant, however, if even more access is required to the infant, at least one of the longitudinal walls 28 can be a door that can drop down fully and the door can be secured to the infant platform 20 in conventional manner by means such as hinges for complete access to the infant to carry out procedures on the infant or for introducing and removing the infant from the incubator 10.

A hood 32 covers the upper peripheral edges of the walls 28 to enclose therein an infant compartment 34 that provides a controlled environment to the infant where heat and humidity can be provided and controlled to aid in the development and wellbeing of the infant. The hood 32 may of a conventional design, however, in the embodiment as shown, the hood 32 can be raised and lowered vertically to cover and uncover the infant compartment 32. The raising and lowering mechanism is not part of the present invention, however a mechanism is described in detail in copending U.S. patent application Ser. No. 09/316,506 filed May 21, 1999 and entitled Lift Mechanism For Infant Care Apparatus Canopy and the disclosure of which is incorporated herein by reference. In general, and which is sufficient for purposes of the present disclosure, the hood 32 is affixed to a movable vertical frame member 36 that moves with respect to, and interfits with stationary vertical frame members 38 and a lifting mechanism is used to move the movable vertical frame members 36 and the hood 32 upwardly and downwardly with respect to the stationary vertical frame members 38.

A heating and air moving compartment 40 is located within the infant platform 20 beneath the flat, planar surface 22 on which the infant is positioned and within the heating and air moving compartment 40 there is located the various components of a convective heating system to be later explained. In essence, the convective heating system serves to introduce heated air into the infant compartment 34 from the heating and air moving compartment 40 and receive return air therefrom.

Another convenient feature includes a drawer 42 positioned beneath the infant platform 20 and which can be used to retain supplies or other devices needed to carry out some operation or procedure on the infant.

A control module 44 is conveniently positioned intermediate the stationary vertical frame members 38 and may include displays of various monitored parameters as well as include the various controls for operation of the functions of the incubator 10. The control module 44 may also contain the alarm functions that may be set by the user or may be established and preset by the manufacturer.

Figure 2:
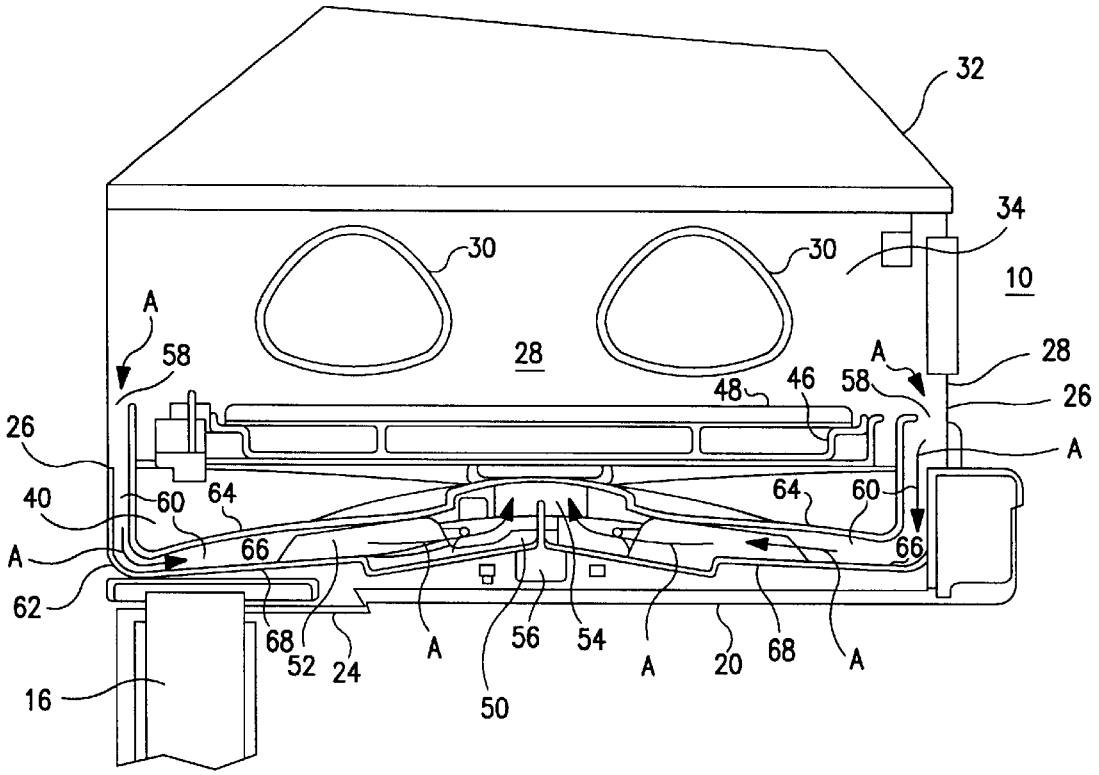
FIG. 2 is an enlarged side cross sectional view of the incubator of FIG. 1.
Figure 3:
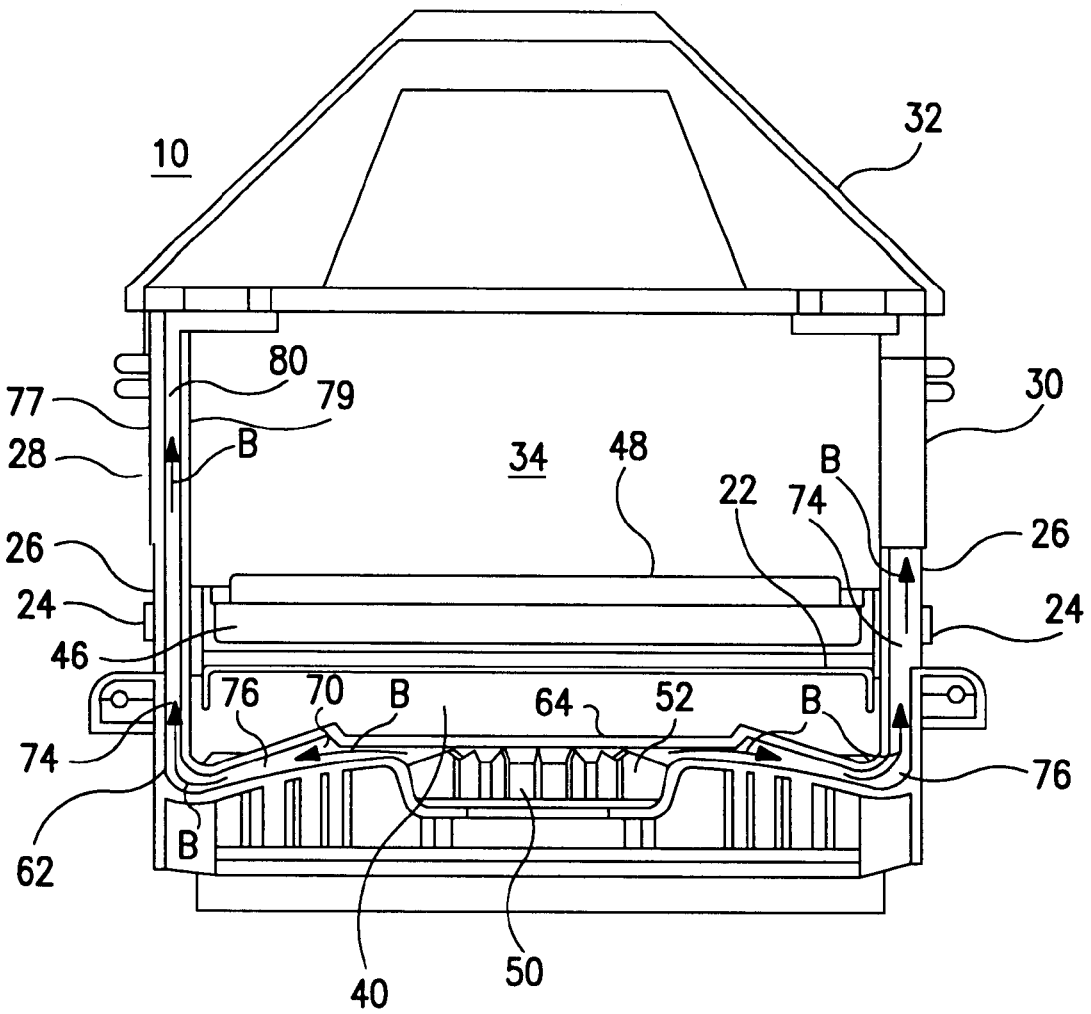
FIG. 3 is an enlarged, end cross sectional view of the incubator of FIG. 1

Turning now to FIGS. 2 and 3, there is shown enlarged side cross sectional and end cross sectional views of the incubator 10. Taking FIG. 2 first, the Figure is looking at the longitudinal side 24 of the incubator 10 and thus shows the movable wall 28 that, as explained, operates as a door to access the full side of the infant positioned within the incubator 10 since the infant is normally positioned with its head to feet axis in the longitudinal direction of the infant compartment 34. Atop the flat planar surface 22 there is mounted a mattress tray 46 and a mattress 48 positioned therein for the comfort of the infant.

Beneath the flat, planar surface 22 is the heating and air moving compartment 40 and which contains the major components of the convective heating system. As can be seen, those components include a heater 50 having fins 52 extending upwardly and a fan 54 powered by a motor 56. The air flow that is shown is the FIG. 2 is the return flow that takes place along the ends 26 of the incubator 10, that is, the shorter dimension of the generally rectangular shaped infant compartment 34. Thus, as is shown, the air in the infant compartment 34 is drawn downwardly through openings 58 that are formed along the both ends 26 of the infant compartment 34. As will be referred to herein, the openings 58 are generally elongated along the ends 26 of the incubator 10, or along the shorter sides of the rectangular infant compartment 34 and will be referred to as the inlets as those openings 58 carry air into the heating and air moving compartment 40 from the infant compartment 34.

The air from the infant compartment 34 thus passes through openings 58 to enter a channel 60 and into a lower chamber 66. The lower chamber 66 and the channel 60 is formed between the chassis 62 of the incubator 10 and an upper pan 64 as will be later explained. Thus, the air passes through the lower chamber 66 to pass along the fins 52 of the heater 50 where the air is heated and enters the fan 54 where the heated air is forced upwardly into an upper chamber 70 (FIG. 3) and through further ducting as will be explained with respect to FIG. 3. To this point, the path of the return air is generally in the direction of the arrows A.

Turning now to FIG. 3, there is shown the flow pattern of the heated air that passes into the infant compartment 34 also along both of the longitudinal sides 24. In the Figure, the fins 52 of the heater 50 can be seen and which lie basically along a longitudinal axis of the infant compartment 34 and the incubator 10. Thus, the heated air is moving along the fins 52 directly into the Figure and that air is forced upwardly into the upper chamber 70 by means of the fan 54 (FIG. 2). The heated air then travels along the shorter axis of the generally rectangular infant compartment 34 along the channel 76, again, formed between the chassis 62 and the upper pan 64 and through outlet openings 74 formed along the longitudinal sides of the infant compartment 34 as shown by the arrows B. Thus, the air flow basically executes a 90 degrees turn in both directions as it passes through the heating and air moving compartment 40, that is, it enters through inlets along the opposite ends 26 of the infant compartment 34 and returns to the infant compartment 34 at the opposite longitudinal sides 24 of the infant compartment 34.

As will later be seen, the various ducting and passages for the flow of that air through the heating and air moving compartment 40 is manage and directed by the specially shaped chassis 62 and the upper pan 64 that is positioned atop of the chassis 62. Both components also form the upper chamber 66 and the lower chamber 70. The chassis 62 and upper pan 64 are both preferably constructed as unitary one-piece molded plastic, more preferably a foamed plastic construction so that basically only two components are to form the various ducting and chambers and thus, the apparatus is easily assembled and constructed.

The heated air further passes through the walls 28 since the walls are double walled doors, each having on outer wall 77 and an inner wall 79 with a passageway 80 formed therebetween. Thus, the heated air passes through the walls 28 to enter the infant compartment 34 at the upper area of the infant compartment 34 as shown by the arrows B.

Figure 4:
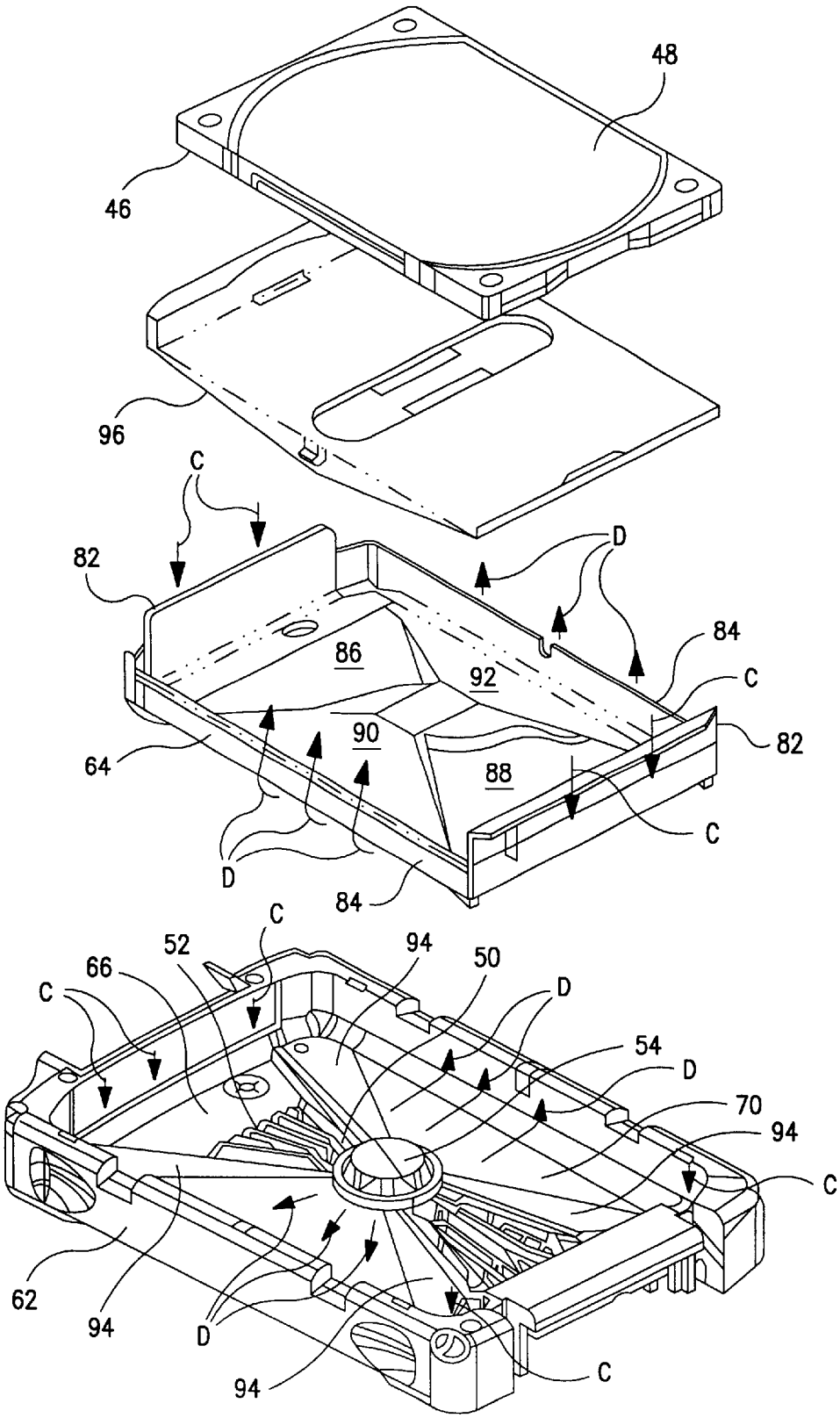
FIG. 4 is an exploded view of the components of the convective heating system of the present invention.

Turning now to FIG. 4, there is shown an exploded view of the various components that comprise the convective heating system used with the present invention. In the Fig., the chassis 62 is shown and which, as explained, is a one-piece molded plastic construction, preferably a foamed plastic by means of a conventional foaming molding process. The preferred material is a foamed polycarbonate and is available from General Electric under its trademark Lexan. As can be seen, by the molded chassis 62, there is formed the lower chamber 66 that depends downwardly and which includes the fins 52 of heater 50. Noting the arrows C, the return path of the air from the infant compartment can be seen as that air passes downward along the inside surface of the chassis 62 to enter the lower chamber 66 to pass over the fins 52 where that air is heated. The heated air thus enters fan 54 where that warmed air thus moves at right angles with respect to the path through the lower chamber 66 to enter upper chamber 70 as shown by the arrows D. As should be seen, the use of lower and upper chambers with respect to the chassis 62 is shown, however, the actual chambers are formed when the upper pan 64 is fitted atop of the chassis 62 in the assembled from of FIGS. 2 and 3.

The same arrow designations are used to show the flow of air with respect to the upper pan 64 where the arrows C indicate the path of the flow of air from the infant compartment and which passes external of the upwardly formed sides 82 of the upper pan 64. The arrows D indicate the path of the air returning to the infant compartment and which passes external of the longitudinal sides 84 of the upper pan 64. In the upper pan, the internal surface is comprised of various opposite facing generally triangular areas, of which the opposite end areas 86 and 88 cover the lower chamber 66 and the longitudinal areas 90, 92 cover the upper chamber 70. The upper pan 64 seals against the chassis 62 at the smaller triangular sealing areas 94 located on the upper surface of the chassis 62. As with the chassis 62, the upper pan 64 is preferably formed of a single piece molded plastic material and may also be of a foamed polycarbonate of the same type as the chassis 62.

As can thus be seen, the use of but two structural foam components, the chassis 62 and the upper pan 64 serves to form the necessary air passages that allow the convective heating system to draw air from the infant compartment downwardly through the inlet and into a lower chamber. From the lower chamber, the air moves generally inwardly along the longitudinal axis of the incubator 10 where it passes through the fan 54 that forces the air into a new direction generally outwardly at a right angle with respect to that longitudinal axis through the upper chamber to return the now heated air to the infant compartment along the longitudinal outlets formed along the longitudinal sides of the infant compartment 34.

Further in FIG. 4, there is a tilt platform 96 located atop of the upper pan 64 and serves the purpose of allowing a tilting action to be employed to tilt the infant to a desired position. Further shown is the mattress tray 46 on which is located the mattress 48 to underlie the infant.

To summarize, therefore, the present incubator 10 comprises an infant platform 20 underlying an infant compartment 34 where the infant is enclosed in a controlled environment. A convective heating system is located in a heating and air moving compartment 40 located in the infant platform 20 just beneath the infant and which serves to force heated air into the infant compartment 34 to heat the infant and to withdraw return air from the infant compartment 34 for re-circulation. The heated air is forced into the infant compartment 34 along both of the longitudinal sides 24 of the generally rectangular infant compartment 34 and continues upwardly though the walls of the incubator through a passage formed in the double, spaced apart walls. The return air leaves the infant compartment 34 along both of the ends of the infant compartment 34. Thus, the flow of air through the infant compartment 34 is balanced and is uniformly distributed to enhance to creation of a uniform temperature profile within the infant compartment 34.

Those skilled in the art will readily recognize numerous adaptations and modifications which can be made to the infant care apparatus of the present invention which will result in an improved control system, yet all of which will fall within the scope and spirit of the present invention as defined in the following claims. Accordingly, the invention is to be limited only by the following claims and their equivalents.

We claim:

1. An incubator having an infant compartment for containing therein an infant, said infant compartment being generally rectangular having opposite sides, said incubator having a heating and air moving compartment, said heating and air moving compartment comprising a molded chassis and a molded plastic upper pan fitted atop of said chassis, said chassis and said upper pan forming a lower air chamber and an upper air chamber, a fan located intermediate said lower and said upper chamber to cause air to flow from said lower chamber into said upper chamber, an inlet disposed along opposite sides of said infant compartment to allow air from said infant compartment to enter said lower chamber, and an outlet disposed along the other opposite sides of said infant compartment to allow air from said upper chamber to enter said infant compartment.

2. An infant incubator as defined in claim 1 wherein said chassis is a molded plastic construction.

3. An infant incubator as defined in claim 2 wherein said upper pan is a molded plastic construction.

4. An infant incubator as defined in claim 3 wherein a heater is located in said lower compartment.

5. An infant incubator as defined in claim 1 wherein said rectangular sides comprise opposite long, longitudinal sides and opposite short sides and wherein said outlets are disposed along said long, longitudinal sides.

* * * * *